United States Patent [19]

Sherden

[11] 3,955,260

[45] May 11, 1976

[54] APPLICATOR FOR CEILING TEXTURE MATERIAL

[76] Inventor: Herbert O. Sherden, 136 Berkshire Drive, Wheeling, Ill. 60090

[22] Filed: July 16, 1975

[21] Appl. No.: 596,393

[52] U.S. Cl. ..... 29/121 R; 15/230.11; 118/DIG. 15; 29/116 R

[51] Int. Cl.[2] ..... B21B 27/02

[58] Field of Search ..... 29/113 R, 113 AD, 116 R, 29/121 R, 121 A, 121 H; 118/DIG. 15, DIG. 17; 15/230, 230.11, 230.16

[56] References Cited

UNITED STATES PATENTS

| | | | |
|---|---|---|---|
| 1,035,959 | 8/1912 | Goldsmith | 29/121 R X |
| 1,573,594 | 2/1926 | Winkenbach | 29/116 R X |
| 1,740,697 | 12/1929 | McManus | 118/DIG. 18 |
| 1,786,190 | 12/1930 | Busch | 29/121 H X |
| 1,957,963 | 5/1934 | Johnstone | 29/121 H X |
| 2,839,785 | 6/1958 | Stevens | 29/121 H X |
| 3,154,830 | 11/1964 | Juchniewicz | 15/230.11 X |
| 3,295,188 | 1/1967 | Saueressig | 29/113 R |

*Primary Examiner*—Alfred R. Guest
*Attorney, Agent, or Firm*—Darbo, Robertson & Vandenburgh

[57] ABSTRACT

A roller type applicator has a plurality of spaced air pockets which project outwardly in the form of nodules. These air pockets are defined by a thin plastic film.

4 Claims, 5 Drawing Figures

APPLICATOR FOR CEILING TEXTURE MATERIAL

BACKGROUND AND SUMMARY OF THE INVENTION

A thick (as compared to paint) texture material is often used to cover ceilings or walls of a room. While it is sometimes used on new construction to create a texture or a surface, it is also commonly used for concealing cracks in a ceiling of an older structure. Such texture materials are thick and viscous. They often comprise a filler in a cementitous binder. As an example of such a material there is "Roll On Texture For Ceilings" sold by National Texture Corporation. For the purposes of convenience, and not to indicate that necessarily a single application is involved, such materials are referred to herein as a texture forming coating material.

In the past a common procedure for finishing a ceiling with such a material would be to apply it with a blade, such as a spatula, a trowel, etc. After it was applied it would be given a desired finish, some of which were: an overall swirl pattern formed with a trowel, etc.; a relatively even, but rough finish with a whisk broom; a deep rough finish with a sponge which was pulled away to draw the material downwardly with it; etc. These generally involve a two-step operation, namely, (1) application of the material, and (2) producing the desired texture on the surface of the already applied material. The material is also applied with a roller, such as a paint roller. However, such a roller will not carry a relatively large "load" of material from the source of supply (such as a paint tray) to the surface being finished. This necessitates repeated return to the source of supply for an additional quantity of material.

The principle object of the present invention is to provide an applicator for a texturizing coating material, which applicator is capable of carrying a substantial load of material from the source of supply to the ceiling, etc., and also which results in a pleasing rough texture to the surface.

Other objects and advantages will become apparent from the following description.

DESCRIPTION OF SPECIFIC EMBODIMENTS

Figure 1:
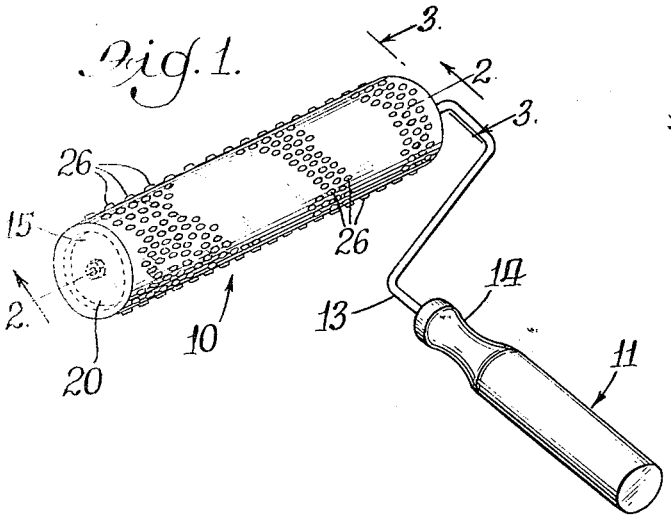
FIG. 1 is a perspective view of a roller applicator embodying the present invention.

The following disclosure is offered for public dissemination in return for the grant of a patent. Although it is detailed to ensure adequacy and aid understanding, this is not intended to prejudice that purpose of a patent which is to cover each new inventive concept therein no matter how others may later disguise it by variations in form or additions or further improvements.

The embodiment of FIGS. 1–4 comprises a slip cover, generally 10, which is used with a conventional paint roller, generally 11, for the purposes of applying a texturizing coating material. The conventional paint roller includes an axle 12 which is unitary with a rod portion 13 on which is secured a handle 14. A pair of wheels 15 are journaled on axle 12. A paint roller sleeve is mounted on the wheels and consists of a cardboard sleeve 16 to which is secured a covering of paint applicator material 17, such as lambs wool, rug material, etc., which would normally form the applicator face.

The slip cover 10 forms the applicator face in accordance with the present invention and comprises a bag of thin, flexible plastic film. This bag has a closed end 20, a cylindrical body 21 and a mouth portion 22. A continuous draw string 23 is woven through openings 24 in the mouth portion 22. This permits the mouth portion 22 to be substantially closed about the axle 12 to hold the slip cover 10 in place on the paint roller sleeve 16, 17. It is not necessary that end 20 be fluid tight, since its purpose is merely to keep the cover 10 from sliding off the roller sleeve 16, 17.

Encircling the cylindrical body portion 21 is a second sheet of film. This second sheet of film has a plurality of nodules 26 which define air pockets 27. The portions of the outer sheet of film which are intermediate and surround the nodules 26 are heat sealed to the inner cylindrical body portion 21, i.e., areas 28. Thus the plastic walls defining the air pockets 27 are fluid impermeable.

Figure 2:
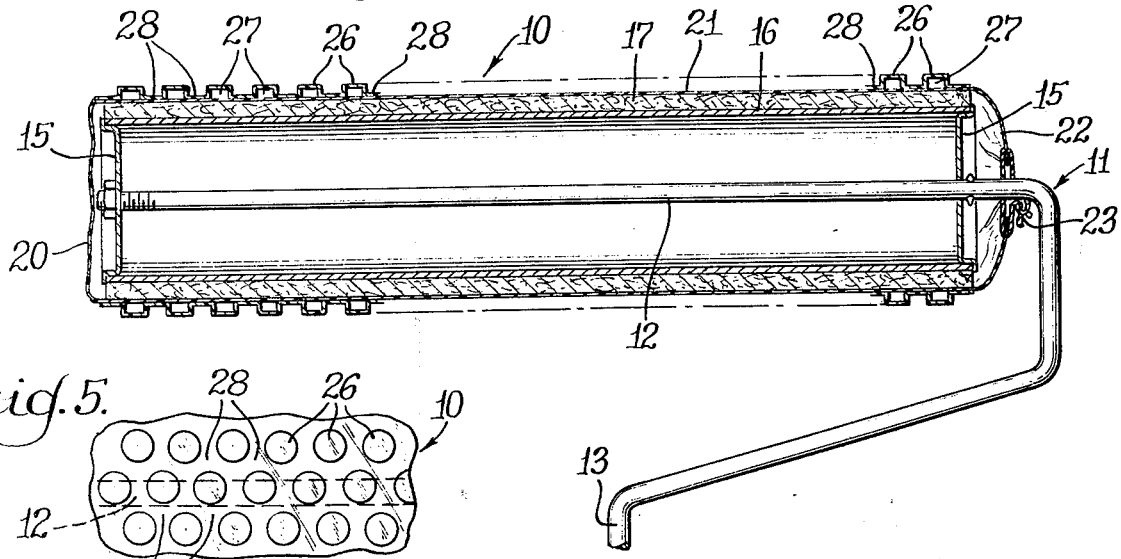
FIG. 2 is a section as seen at line 2—2 of FIG. 1.
Figure 5:
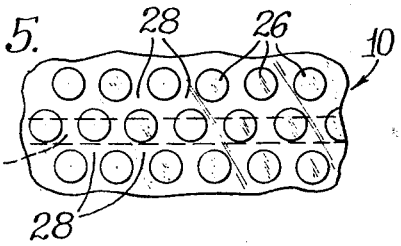
FIG. 5 is a fragmentary developed view of the applicator face of the present invention.
Figure 4:
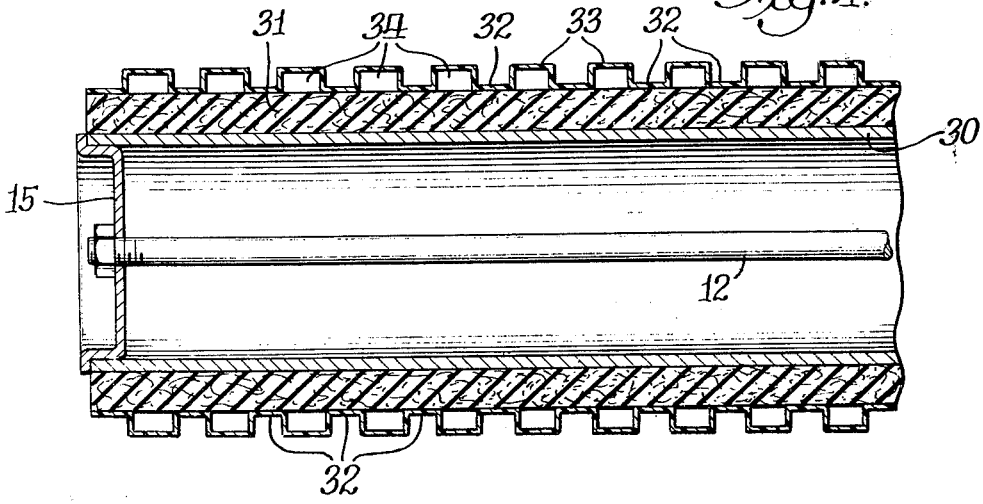
FIG. 4 is a partial longitudinal section of a second embodiment of the invention.

The embodiment of FIG. 4 comprises a roller sleeve per se which is used upon the sleeve holder comprising the axle, handle and wheels of the type illustrated in FIGS. 1 and 2. This embodiment includes an inner cardboard sleeve 30 having a foam rubber cushion 31 thereabout and secured thereto. Surrounding and secured to the foam rubber cushion is a single sheet of thin plastic film. In the areas 32 the film is affixed to the rubber cushion as by means of heat sealing, an adhesive, etc. The film forms a plurality of nodules 33 which define air pockets 34. At least the outer surface of the rubber cushion 31 is fluid impermeable (as is the plastic defining the nodules) so that the air will not be lost from the air pockets 34.

In the illustrated embodiments, the nodules are cylindrical with their axes lying on radial lines about axle 12. The diameter of the cylinder (the nodule) is about 0.6 centimeters. The nodules project outwardly from the intermediate areas 28, 32, a distance of approximately 0.3 centimeters. The nodules occupy approximately 50 percent of the surface area. These sizes can be varied depending upon the texture desired for the finished surface. However, the density of the nodules should remain in the range of somewhat less than one to about three nodules per square centimeter with the nodules occupying between about 20 to about 80 percent of the surface area.

In applying the texturizing material to a surface, the first step is, of course, the preparation of the texturizing material, that is, many such materials are not premixed but are in dry form. The are then mixed with water to a consistency which may be termed paste-like or comparable to cake icing. I have also had good results using taping compound (a mastic material used in the taping of joints and covering imperfections of plasterboard) as a texturizing material with embodiments of the present invention. The prepared material can then be put in a paint roller tray or merely on a generally flat work area. By rolling the roller embodying the present invention in the material, the roller is loaded up with the texturizing material. The roller so loaded is then rolled on the surface to be coated, as for example the ceiling 37 illustrated in FIG. 3. As the roller is rolled along that surface, the material 38 loaded into the roller is applied as a layer 39 on the ceiling 37 or other surface. Since the nodules are formed by a flexible film and since the air within the nodules is quite mobile, they will not retain an exact shape. Under the pressure of rolling the material 38 onto the surface 37, the nodules deflect. They do not leave an imprint of their original shape. The resulting texture of the layer 39 on the surface 37 resembles that of stucco.

Figure 3:
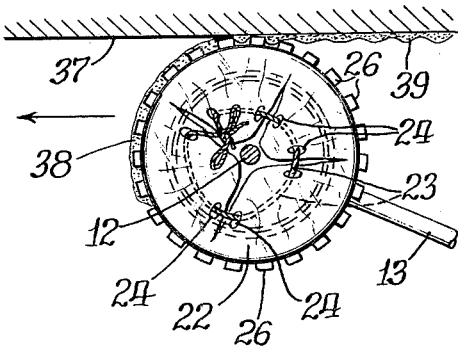
FIG. 3 is an end view of the embodiment of FIG. 1 as used in applying texturizing coating material to a ceiling.

An embodiment such as that of FIGS. 1–3 is very inexpensive, even as compared to the cost of a paint roller 16, 17. Thus they can be made as a disposable item, and the user need have no desire to spend the time of cleaning them after use in an effort to salvage them for reuse.

I claim:

1. In a roller apparatus for applying a texture coating material to a surface such as a wall, which apparatus comprises a roller and means about said roller forming an applicator face, the improvement wherein:

said means forms a plurality of nodules projecting from said face, each nodule comprised of a flexible, fluidtight wall with a fluid therein.

2. In an apparatus as set forth in claim 1, wherein said face has a density of approximately 1 to 3 nodules/cm$^2$, and occupy between about 20 and about 80 percent of the surface area.

3. In an apparatus as set forth in claim 2, wherein each nodule is generally cylindrical with an axis on a radial line of the roller, said cylinder having a diameter of about 0.6 cm. and an axial length of about 0.3 cm.

4. In an apparatus as set forth in claim 1 and wherein the roller is a sleeve, the further improvement comprising:

said means comprising a bag of thin plastic film having a substantially closed end and an open end, means for holding the open end in gathered position after the bag has been placed over the sleeve and the open end gathered, said nodules being on the exterior of said bag.

* * * * *